US009173458B2

(12) United States Patent
Wang

(10) Patent No.: US 9,173,458 B2
(45) Date of Patent: Nov. 3, 2015

(54) WATERPROOF, ANTI-SPLIT, HIGH TRANSVERSE TENSILE STRENGTH DOUBLE-LAYER ZIPPER AND ITS FABRICATION METHOD

(71) Applicant: Lien-Chou Wang, New Taipei (TW)

(72) Inventor: Lien-Chou Wang, New Taipei (TW)

( * ) Notice: Subject to any disclaimer, the term of this patent is extended or adjusted under 35 U.S.C. 154(b) by 144 days.

(21) Appl. No.: 13/912,310

(22) Filed: Jun. 7, 2013

(65) Prior Publication Data

US 2014/0359978 A1 Dec. 11, 2014

(51) Int. Cl.

| | |
|---|---|
| ***A44B 19/24*** | (2006.01) |
| ***A44B 19/26*** | (2006.01) |
| ***A44B 19/32*** | (2006.01) |
| ***A44B 19/42*** | (2006.01) |

(52) U.S. Cl.

CPC ..... *A44B 19/42* (2013.01); *A44B 19/32* (2013.01); *Y10T 24/2514* (2015.01); *Y10T 29/49782* (2015.01)

(58) Field of Classification Search

CPC ..... A44B 19/26; A44B 19/42
USPC ..... 24/384, 391, 392, 394, 395, 396, 405, 24/413, 389

See application file for complete search history.

(56) References Cited

U.S. PATENT DOCUMENTS

| | | | | | |
|---|---|---|---|---|---|
| 2,910,754 | A * | 11/1959 | Morin | 24/384 |
| 3,022,559 | A * | 2/1962 | Berberich | 24/392 |
| 3,762,108 | A * | 10/1973 | Pierson | 52/2.23 |
| 4,601,085 | A * | 7/1986 | Yoshida et al. | 24/384 |
| 4,641,400 | A * | 2/1987 | Moreland | 24/389 |
| 4,724,586 | A * | 2/1988 | Tsubokawa et al. | 24/384 |
| 4,942,648 | A * | 7/1990 | Yoshida | 24/389 |
| 4,977,662 | A * | 12/1990 | Moreland | 24/389 |
| 4,987,657 | A * | 1/1991 | Moreland | 24/389 |
| 5,129,127 | A * | 7/1992 | Hamatani | 24/394 |
| 5,386,616 | A * | 2/1995 | Norvell | 24/389 |
| 9,089,187 | B2 * | 7/2015 | Takano | A44B 19/08 |
| 2005/0235466 | A1 * | 10/2005 | Segawa | A44B 19/34 24/396 |
| 2006/0282995 | A1 * | 12/2006 | Liou | 24/389 |
| 2010/0125982 | A1 * | 5/2010 | Chou | 24/397 |
| 2012/0272488 | A1 * | 11/2012 | Wang | 24/389 |
| 2013/0104348 | A1 * | 5/2013 | Wang | 24/392 |

* cited by examiner

*Primary Examiner* — Victor Batson
*Assistant Examiner* — Jason W San
(74) *Attorney, Agent, or Firm* — Jackson IPG PLLC; Demian K. Jackson

(57) ABSTRACT

A waterproof, airtight, anti-slit, high transverse tensile strength double-layer zipper made by: stitching a continuous polyester chain to a middle part of a broad-width fabric tape and then separating the continuous polyester chain into left and right series of interlocking teeth after zipper chain tape dyeing and drying and gluing processes, and then folding up the zipper chain tape and stitching up the open side of the folded zipper chain tape so as to obtain a single-sided double-layer zipper chain tape, and then using a zipper slider to couple two single-sided double-layer zipper chain tapes, thereby obtaining a waterproof, airtight, anti-slit, high transverse tensile strength double-layer zipper. Alternatively, the continuous polyester chain can be stitched to the broad-width fabric tape near its one lateral side for making a high-strength double-layer zipper with less fabric consumption.

6 Claims, 13 Drawing Sheets

WATERPROOF, ANTI-SPLIT, HIGH TRANSVERSE TENSILE STRENGTH DOUBLE-LAYER ZIPPER AND ITS FABRICATION METHOD

BACKGROUND OF THE INVENTION

1. Field of the Invention

The present invention relates to zip fasteners and more particularly, to a method for making a waterproof, airtight, anti-slit, high transverse tensile strength double-layer zipper and a waterproof, airtight, anti-slit, high transverse tensile strength double-layer zipper thus made.

2. Description of the Related Art

Most conventional polyester zippers are of a single layer design 7 (see FIG. 1). After stitched an interlocking series of teeth to each of two zipper tapes, a waterproof film (not shown) is coated on or bonded to the back walls of the two zipper tapes, and then use a thin cutter blade to cut off the waterproof film between the two zipper tapes, and then attach a zipper slider to the two interlocking series of teeth. This single layer design polyester zipper can provide a simple waterproof function when receives no transverse force, however, it is not airtight. The claims and embodiment in U.S. Pat. No. 4,601,085 discloses a double-layer zipper 8 (see FIG. 17) for diving suit. This design of double-layer zipper effectively achieves waterproof and airtight effects. In order to achieve the expected waterproof function, the intermediate fabric tape 82 has a certain thickness and the tape edge 821 protrudes over the end edges 81 of the upper and lower interlocking series of teeth 8 at a distance 80, however, these features tighten the sliding movement of the zipper slider to close the zipper, causing friction between the interlocking teeth and the zipper slider and shortening the lifespan of the zipper.

Further, according to the aforesaid prior art design of U.S. Pat. No. 4,601,085, in addition to the drawback that the tape edge 821 protrudes over the end edges 81 of the upper and lower interlocking series of teeth 8 at a distance 80, the large thickness of the coating of flexible glue 9 makes the structure of the intermediate fabric tape 82 and the coating of flexible glue 9 not steady, affecting the sliding smoothness of the zipper slider (not shown), and the interlocking teeth may be forced out of engagement position when the zipper slider is pulled with force. If a hard glue coating is used to substitute for the coating of flexible glue, the zipper slider may become immovable. Therefore, this prior art design of double-layer zipper can simply be used in diving suits, not applicable to other waterproof articles.

SUMMARY OF THE INVENTION

The present invention has been accomplished under the circumstances in view. The technical concept of the present invention is based on the roller zipper slider type double-layer zippers of U.S. Pat. No. 8,381,369 invented by the present inventor.

It is the main object of the present invention to provide a waterproof, airtight, anti-slit, high transverse tensile strength double-layer zipper and its fabrication method, which has the advantages of waterproof, airtight, anti-slit, high transverse tensile strength characteristics, and facilitates smooth sliding movement of the zipper slider.

It is another object of the present invention to provide a waterproof, airtight, anti-slit, high transverse tensile strength double-layer zipper and its fabrication method, which has a metal wire embedded yarn core (or elastic plastic rod) wrapped in each double-layer zipper tape, making the double-layer zipper practical for use in an electronic burglar alarm, night lighting or any of a variety of other electronic/electrical equipment devices.

It is still another object of the present invention to provide a waterproof, airtight, anti-slit, high transverse tensile strength double-layer zipper and its fabrication method, which has a flexible metallic mesh tape wrapped in each double-layer zipper tape to enhance waterproof, airtight, anti-slit and high transverse tensile strength characteristics of the double-layer zipper, making the double-layer zipper practical for use in a hard travel bag.

It is still another object of the present invention to provide a waterproof, airtight, anti-slit, high transverse tensile strength double-layer zipper and its fabrication method, which uses a broad-width fabric tape having middle reference line for making the desired zipper chain tape, wherein within a predetermined left-right range around the middle reference line, the weft density remains unchanged to maintain the transverse tensile strength of the broad-width fabric tape, however the warp yarns are sparsely woven within this left-right range, providing open spaces that can be filled up by the applied waterproof adhesive or hot melt adhesive glue during fabrication of the double-layer zipper, and therefore the waterproof and airtight ability of the double-layer zipper is enhanced.

DETAILED DESCRIPTION OF THE INVENTION

Referring to FIGS. 2-16, the invention provides a waterproof, airtight, anti-slit, high transverse tensile strength double-layer zipper and its fabrication method. Instead of the conventional techniques of using two zipper tapes for making a zipper, the technical concept of the invention is to use one single piece of thin-thickness broad-width fabric tape 62 and one continuous piece of polyester zipper chain 61 for making a double-layer zipper. The invention also changes the structural design of the needle plate of the stitching machine, achieving smooth transfer of the zipper tape for steadily stitching.

Figure 1:
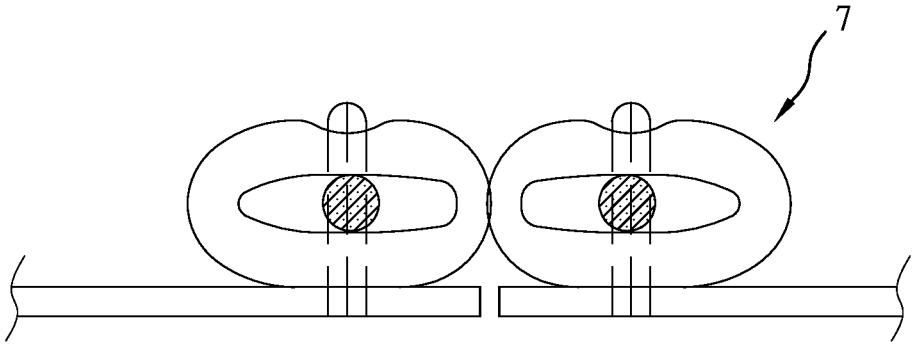
Fig. 1 PRIOR ART
FIG. 1 is a schematic front plain view of a single layer polyester zipper according to the prior art.
Figure 2:
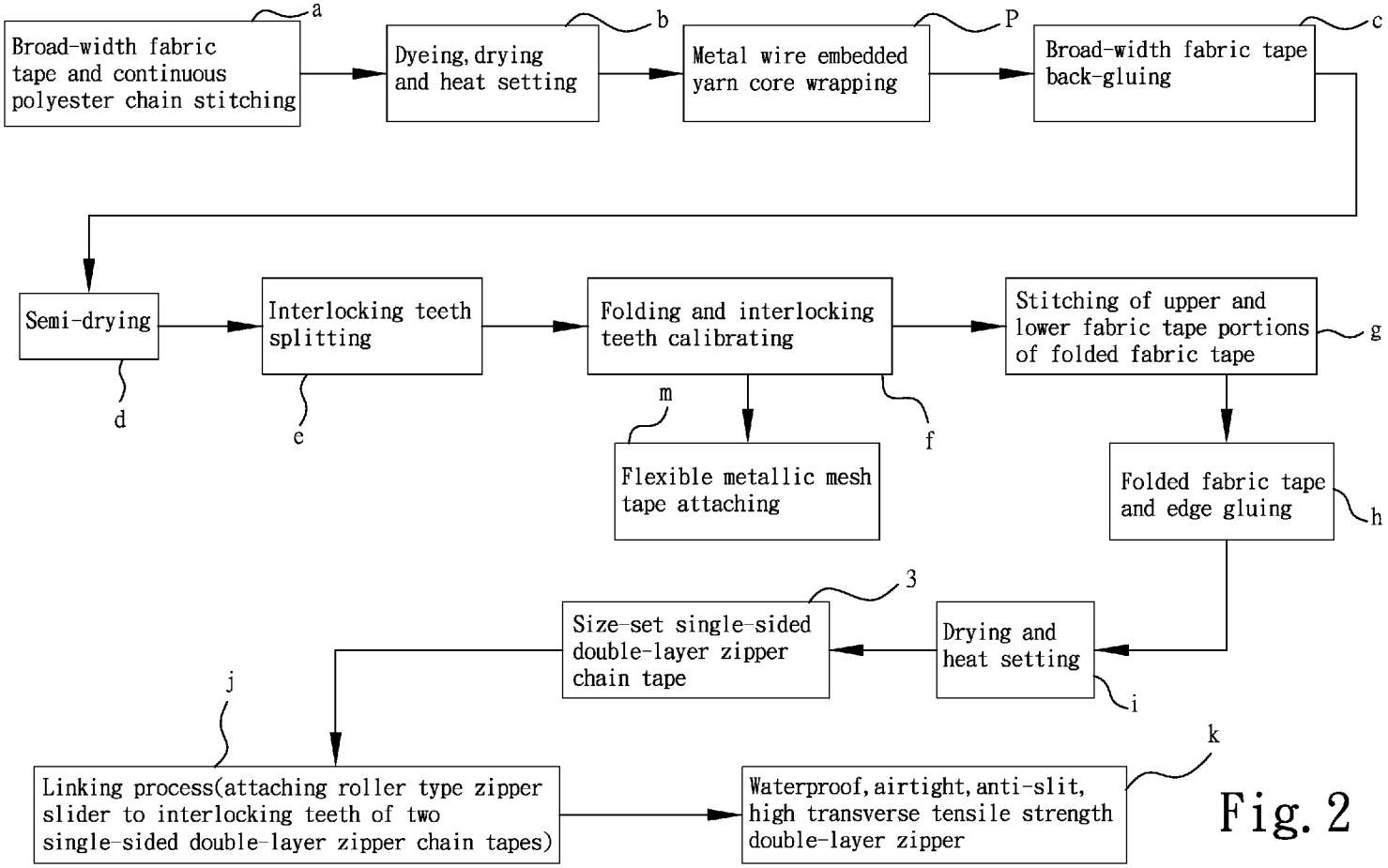
FIG. 2 is a waterproof, airtight, anti-slit, high transverse tensile strength double-layer zipper manufacturing flow chart in accordance with the present invention.
Figure 3:
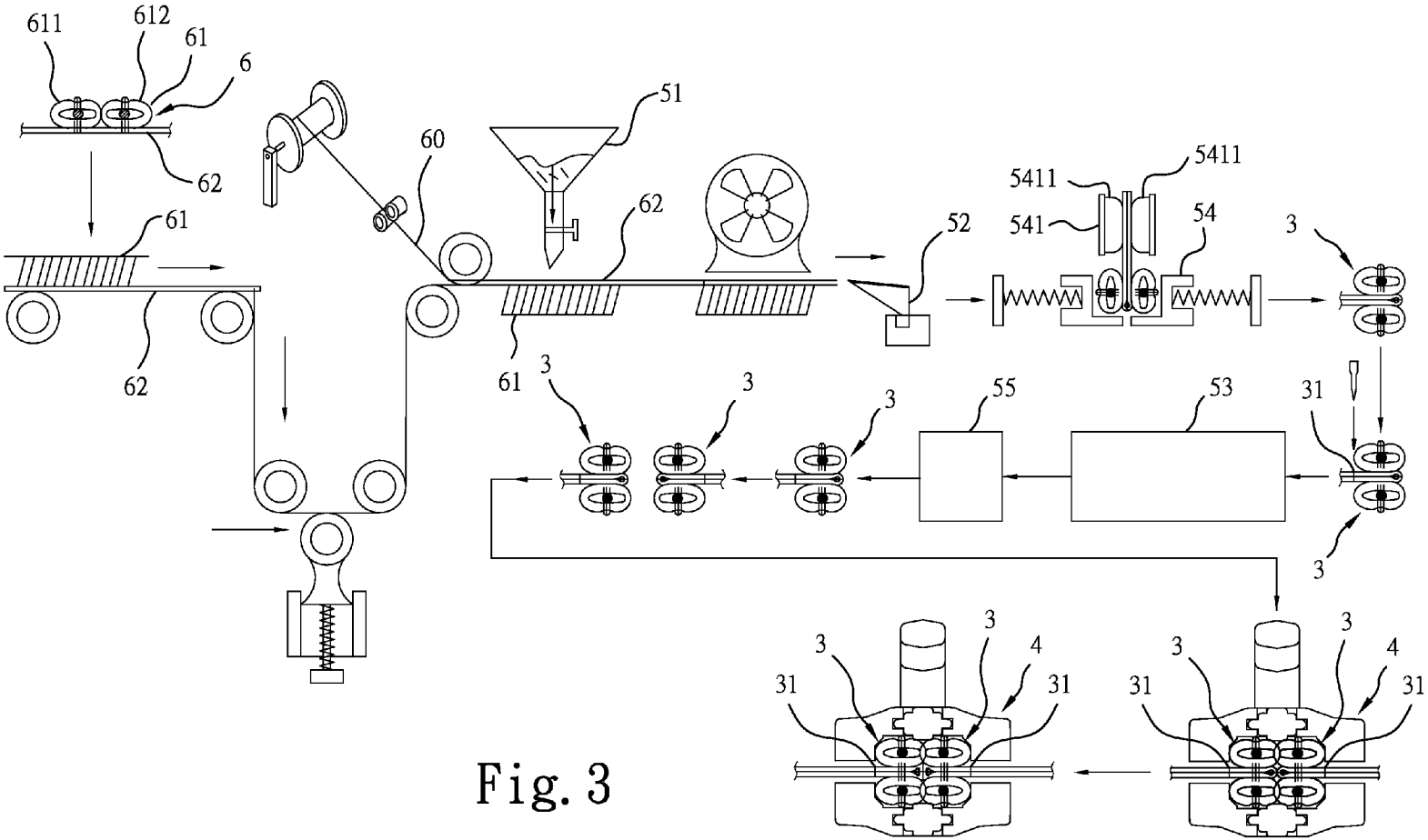
FIG. 3 is a schematic plain view illustrating the fabrication of the waterproof, airtight, anti-slit, high transverse tensile strength double-layer zipper in accordance with the present invention.
Figure 4:
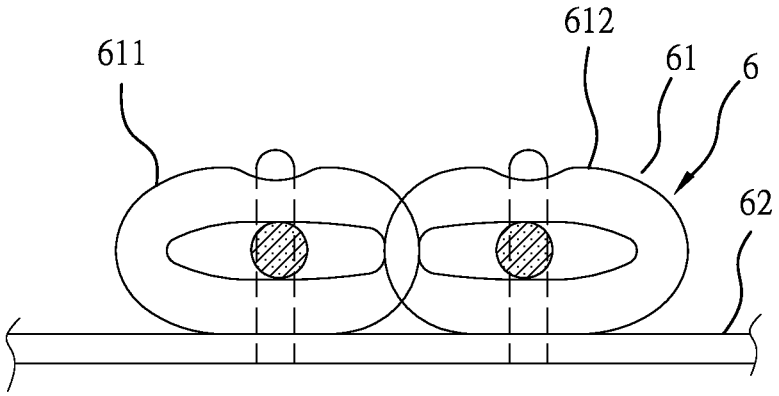
FIG. 4 is a schematic front plain view illustrating a continuous polyester chain stitched to a single piece of thin-thickness broad-width fabric tape according to the present invention.
Figure 5:
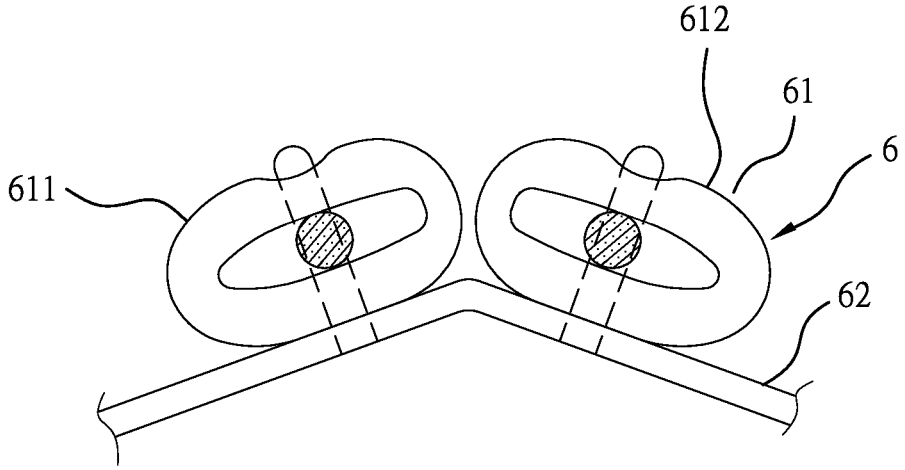
FIG. 5 corresponds to FIG. 4, illustrating the continuous polyester chain split into left and right series of interlocking teeth.
Figure 6:
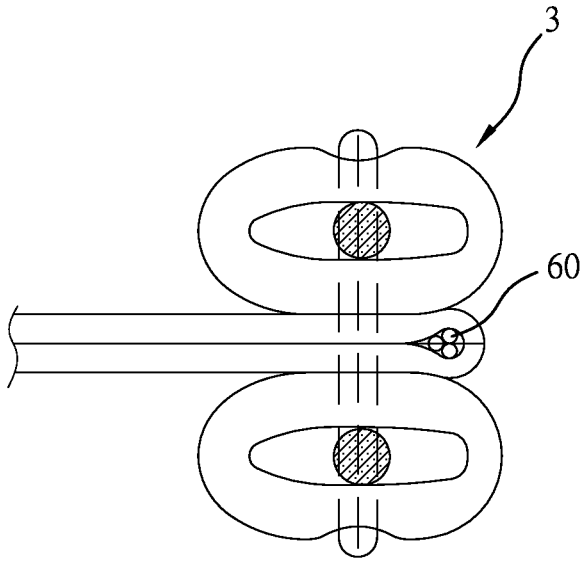
FIG. 6 corresponds to FIG. 5, illustrating a metal wire embedded yarn core (or elastic plastic rod) attached to the thin-thickness broad-width fabric tape and the thin-thickness broad-width fabric tape folded into a double-layer zipper tape.
Figure 7:
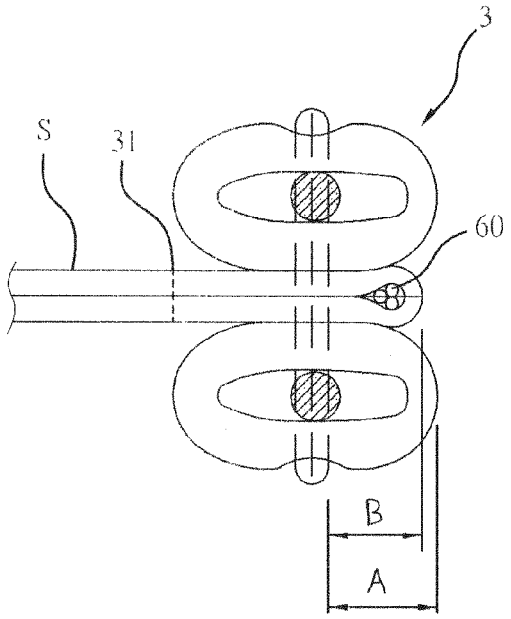
FIG. 7 corresponds to FIG. 6, illustrating the double-layer zipper tape stitched up.
Figure 8:
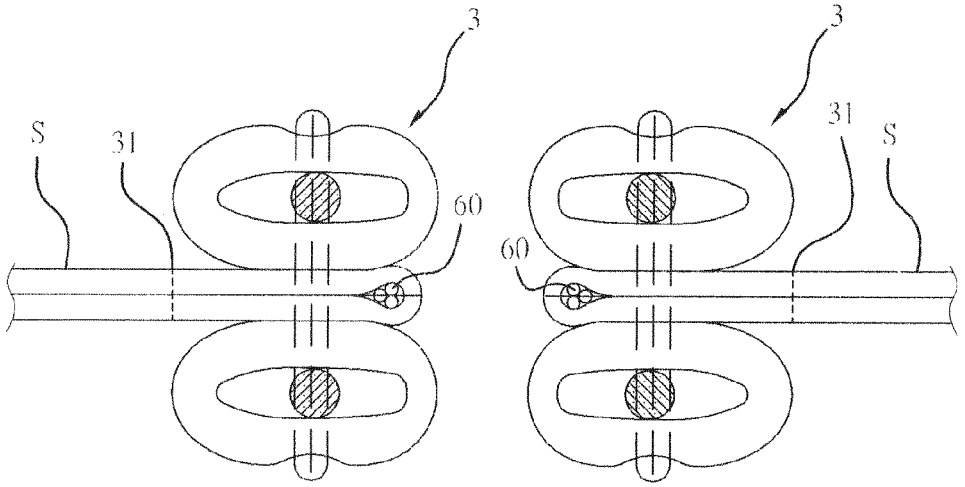
FIG. 8 is a schematic front plain view illustrating two double-layer zipper chain tapes arranged together according to the present invention.
Figure 9:
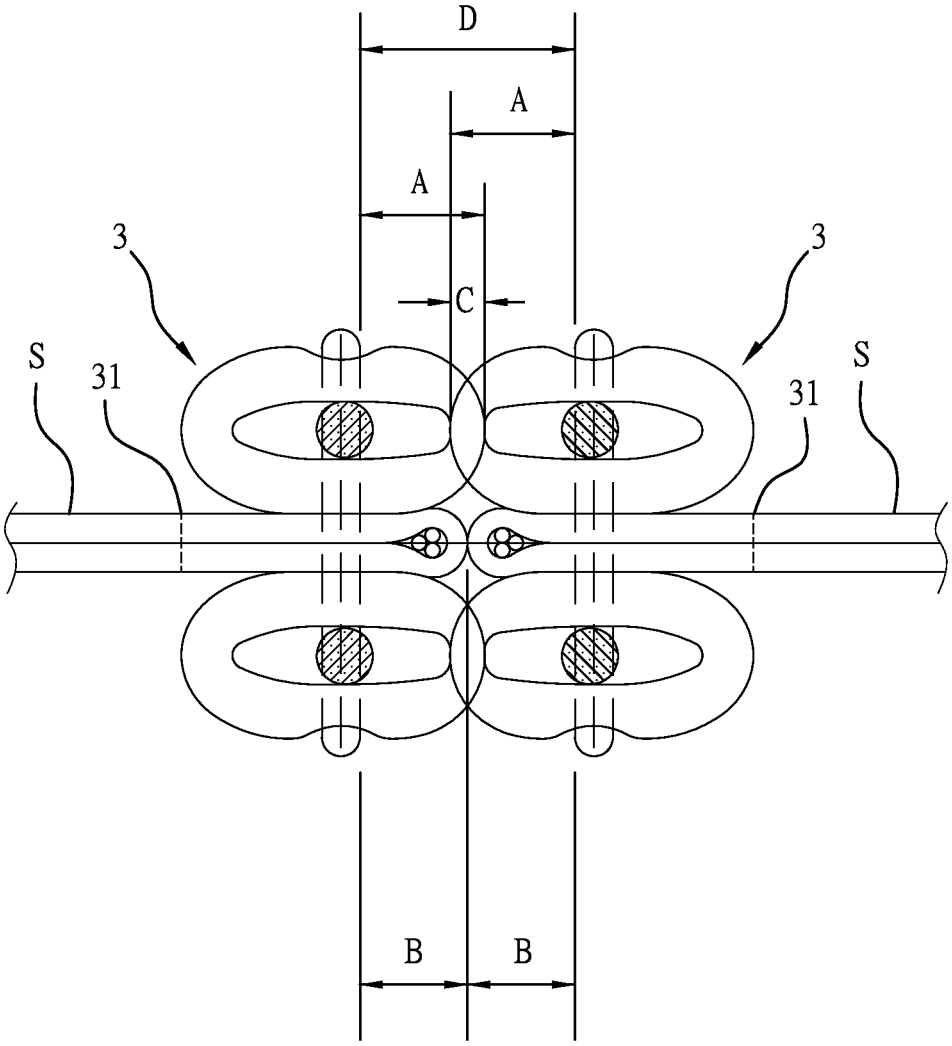
FIG. 9 corresponds to FIG. 8, illustrating the two double-layer zipper chain tapes attached together.
Figure 10:
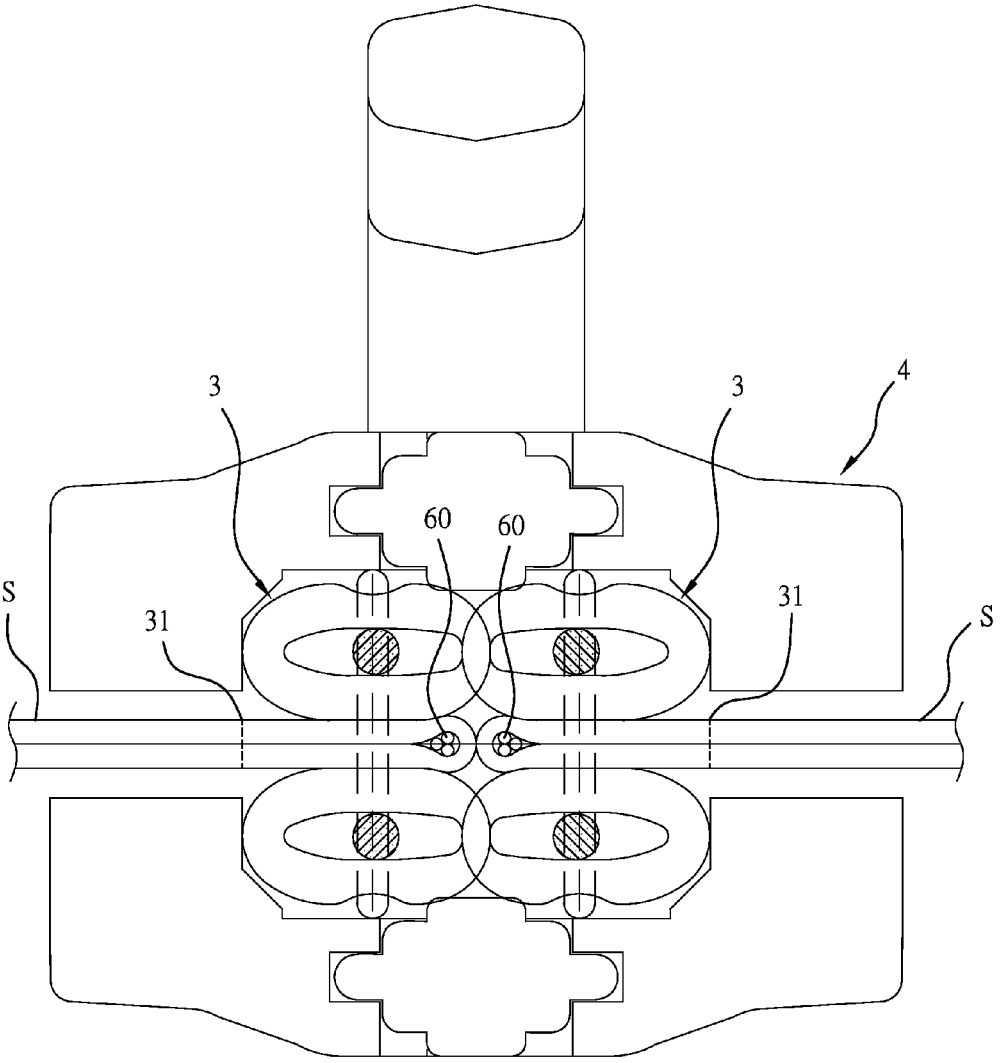
FIG. 10 corresponds to FIG. 9, illustrating a roller type zipper slider coupled to the interlocking series of teeth of the double-layer zipper chain tapes.
Figure 11:
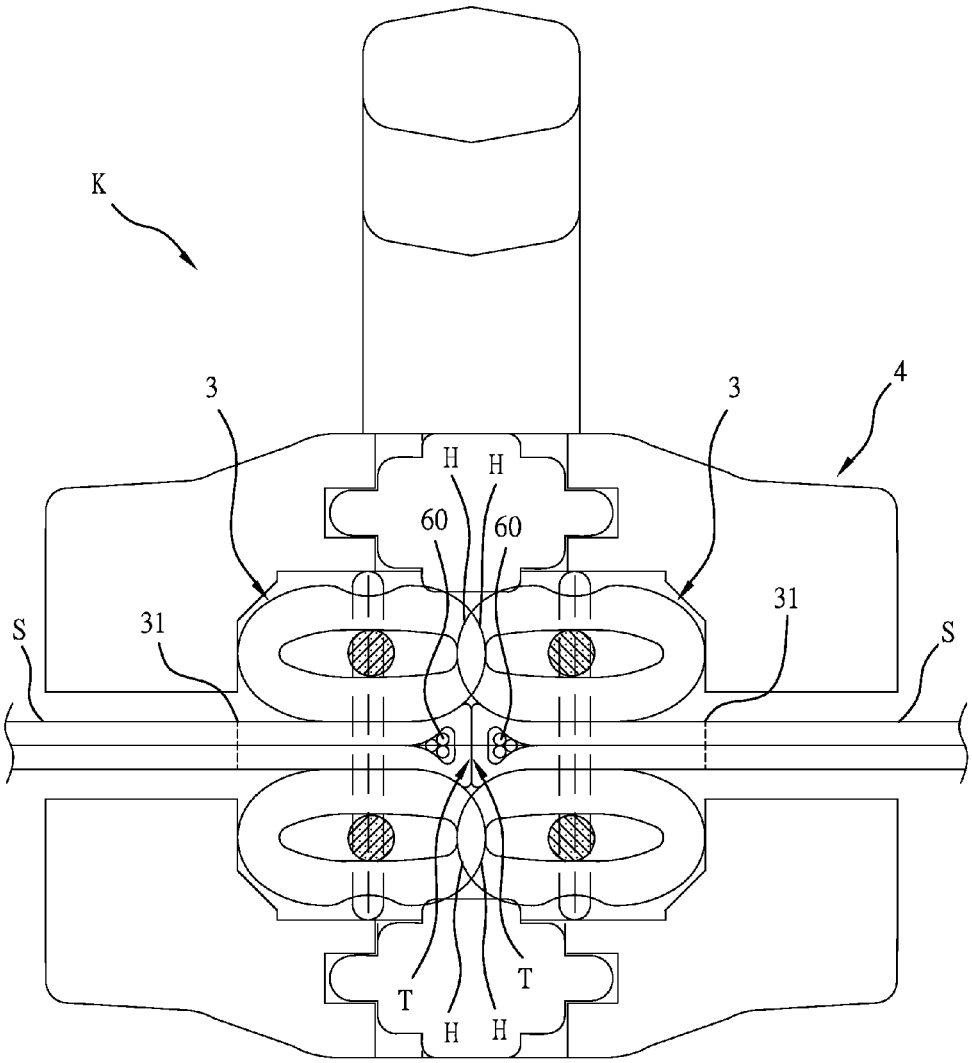
FIG. 11 is a schematic front plain view of a finished waterproof, airtight, anti-slit, high transverse tensile strength double-layer zipper made according to the present invention.
Figure 12:
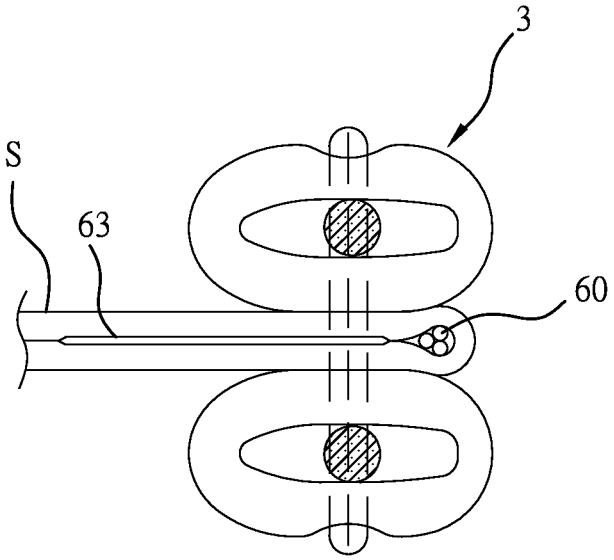
FIG. 12 corresponding to FIG. 6, illustrating a flexible metallic mesh tape wrapped in the double-layer zipper tape.
Figure 13:
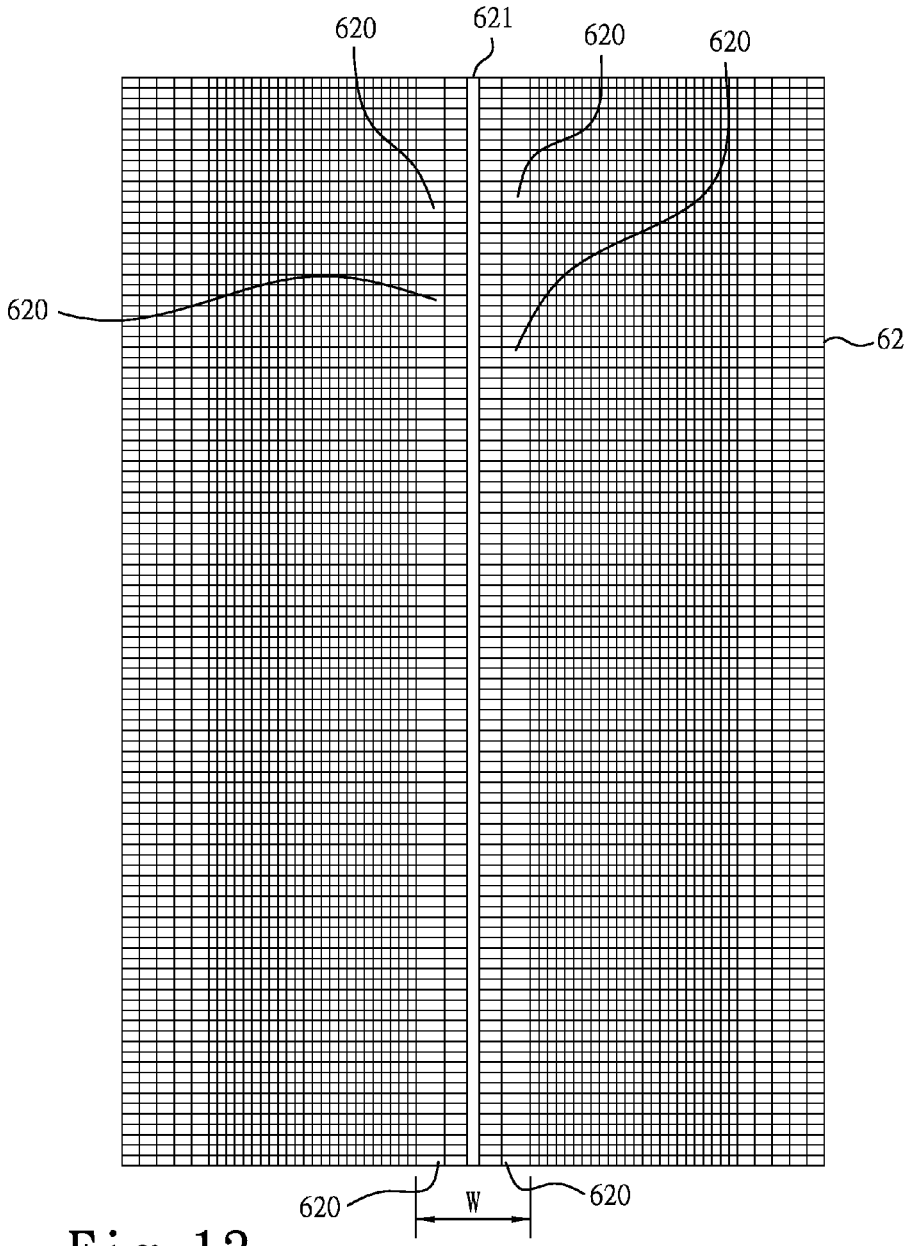
FIG. 13 is a schematic top plain view of the thin-thickness broad-width fabric tape of the double-layer zipper tape shown in FIG. 12.
Figure 14:
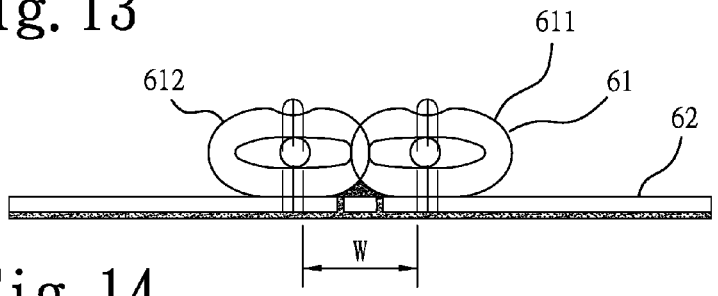
FIG. 14 is a schematic front plain view illustrating the applied waterproof adhesive the thin-thickness broad-width fabric tape (hot melt adhesive glue) merged in the broad-width fabric tape according to the present invention.
Figure 15:
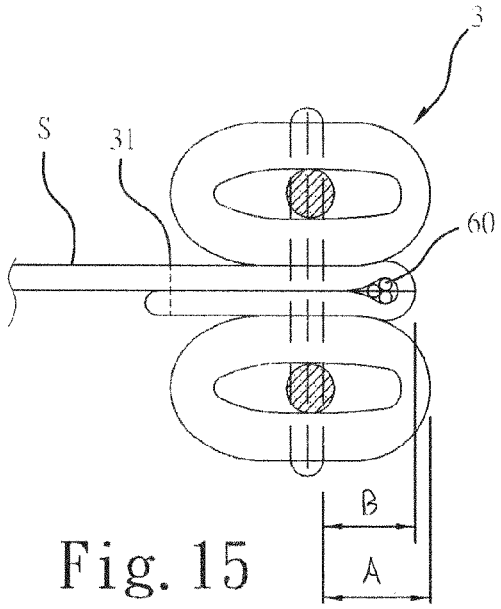
FIG. 15 is a schematic front plain view illustrating two double-layer zipper chain tapes secondarily stitched in accordance with a third embodiment of the present invention.
Figure 16:
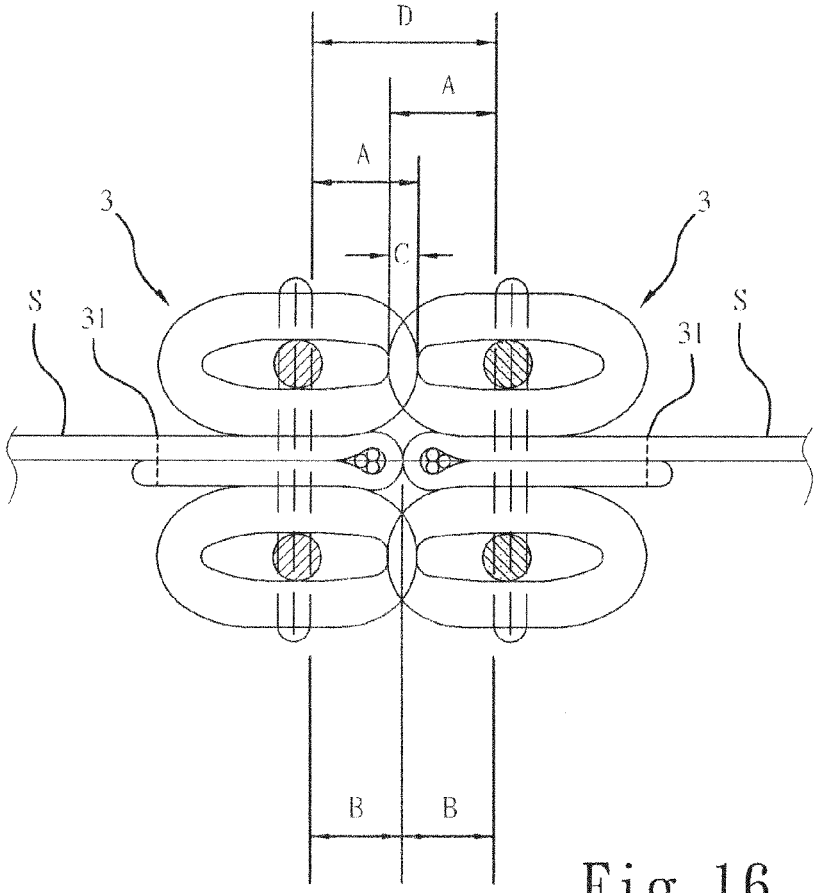
FIG. 16 is a schematic front plain view of the third embodiment of the present invention, illustrating two interlocking series of teeth meshed together.
Figure 17:
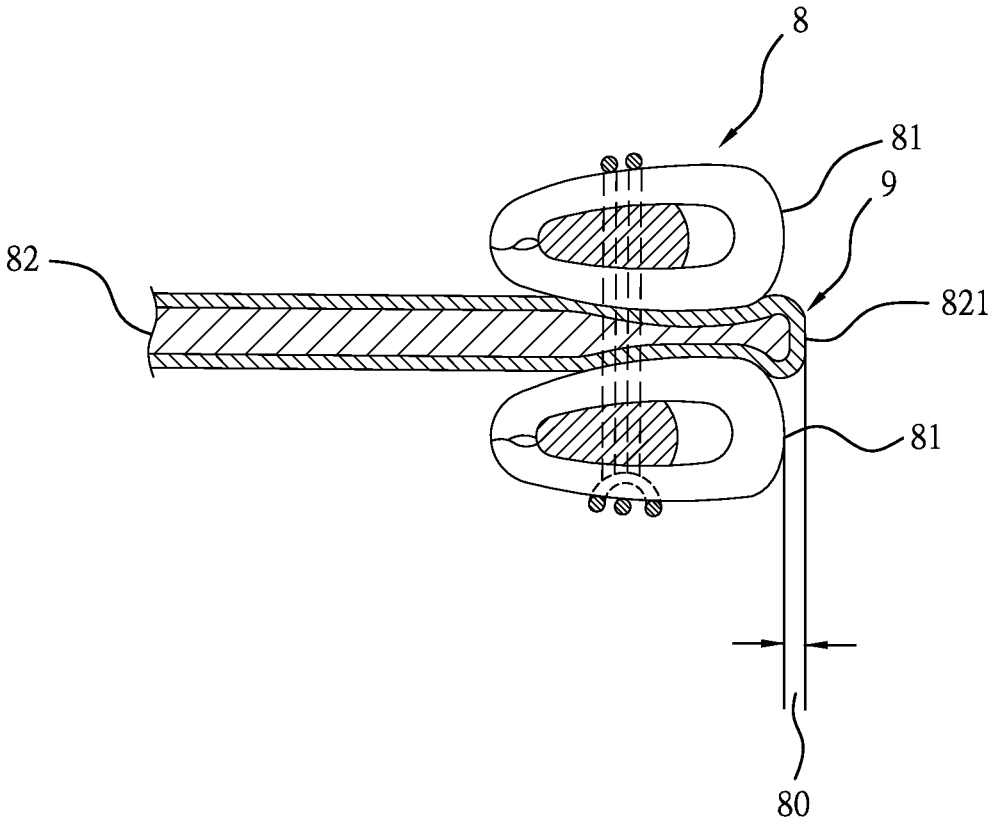
Fig. 17 PRIOR ART
FIG. 17 is a schematic sectional view of a double-layer zipper according to the prior art.

The waterproof, airtight, anti-slit, high transverse tensile strength double-layer zipper fabrication method includes the steps of:

(a) stitching continuous polyester chains 61 to the front wall of a broad-width fabric tape 62 (see FIG. 2) on the middle to form a zipper chain tape 6 having integrated opposing left and right series of interlocking teeth 611; 612 (see FIG. 3 and FIG. 4);

(b) employing dyeing and drying processes to dye the zipper chain tape 6, and to dry the colored zipper chain tape 6 and to set it in heat (if the left and right series of interlocking teeth 611; 612 are separated, they can be caused to deform during the high-temperature high-pressure dyeing process);

(c) using a gluing device 51 to cover a layer of waterproof adhesive or hot melt adhesive glue on the opposing back wall of the broad-width fabric tape 62 of the zipper chain tape 6;

(d) baking the glued zipper chain tape 6 to a semi-dried status;

(e) using a splitter 52 to separate the integrated left and right series of interlocking teeth 611; 612 of the glued zipper chain tape 6 (see FIG. 5);

(f) using a folding and calibration guide device 54, which comprises left and right interlocking teeth calibrators 541 each having a semi-circular body 5411 formed a resilient steel strip, to fold up the glued zipper chain tape 6 and to correct the interlocking teeth 611; 612 and to have the folded zipper chain tape 6 to be secured in the folded condition by the layer of waterproof adhesive or hot melt adhesive glue, thereby obtaining a single-sided double-layer zipper chain tape 3 (see FIG. 3 and FIG. 6);

(g) stitching S the open side 31 of the upper and lower fabric tape portions of the folded fabric tape of the single-sided double-layer zipper chain tape 3 fixedly together (see FIG. 3 and FIG. 7);

(h) using an end-edge gluing device 53 to cover the end edge of the closed side of the upper and lower fabric tape portions of the folded fabric tape of the single-sided double-layer zipper chain tape 3 with a layer of waterproof adhesive;

(i) using a drying device 55 to dry and heat the single-sided double-layer zipper chain tape 3 and to set the shape; and (j) preparing two single-sided double-layer zipper chain tapes 3 subject to the aforesaid steps (see FIGS. 2, 3, 10 and 11) and attaching a roller type zipper slider 4 to the interlocking teeth of these two single-sided double-layer zipper chain tapes 3 (see FIG. 10 and FIG. 11) to form a waterproof, airtight, anti-slit, high transverse tensile strength double-layer zipper K (see FIG. 11) where the inner end edges T of the two double-layer zipper tapes S are firmly stopped against each other when the zipper is closed, achieving waterproof and airtight effects.

Further, after step (b) and prior to step (c), a sub step (p) can be employed to attach a metal wire embedded yarn core (or elastic plastic rod) 60 to the top wall of a broad-width fabric tape 62 of the zipper chain tape 6 on the middle (see FIG. 3 and FIG. 6). Thus, the end edge of the closed side of the upper and lower fabric tape portions of the folded fabric tape of the single-sided double-layer zipper chain tape 3 is stuffed with the metal wire embedded yarn core (or elastic plastic rod) 60 that reinforces the structural strength of the end edge of the closed side of the upper and lower fabric tape portions of the folded fabric tape of the single-sided double-layer zipper chain tape 3, making the double-layer zipper practical for use in an electronic burglar alarm, night lighting or any of a variety of other electronic/electrical equipment devices.

Further, during step (f) to fold up the glued zipper chain tape 6 and to correct the interlocking teeth and to have the folded zipper chain tape 6 to be secured in the folded condition by the layer of waterproof adhesive or hot melt adhesive glue, a sub step (m) can be employed to attach a flexible metallic mesh tape 63 to the broad-width fabric tape 62 (see FIG. 12), enabling the flexible metallic mesh tape 63 to be wrapped in the double-layer zipper tape S of the folded zipper chain tape 6 to enhance waterproof, airtight, anti-slit and high transverse tensile strength characteristics for use in a hard travel bag.

Theoretically, to achieve waterproof and airtight effects, the cross-locking distance between the two series of interlocking teeth of the left and right zipper chain tapes of the waterproof, airtight, anti-slit, high transverse tensile strength double-layer zipper determines the abutment tightness between the inner end edges T of the two double-layer zipper tapes of the left and right zipper chain tapes of the waterproof, airtight, anti-slit, high transverse tensile strength double-layer zipper. The invention has a flexible metallic mesh tape 63 wrapped in each double-layer zipper tape of the left and right zipper chain tapes of the waterproof, airtight, anti-slit, high transverse tensile strength double-layer zipper, enhancing the abutment tightness between the inner end edges T of the two double-layer zipper tapes of the left and right zipper chain tapes of the waterproof, airtight, anti-slit, high transverse tensile strength double-layer zipper. The morphological space design of the present invention is subject to $A+A-C=D$, $2B \geq D$, and $2B<2A$ wherein A is the distance between the stitching line at the interlocking series of teeth of each zipper chain tape and the outer end edge of the respective interlocking series of teeth (see FIG. 7 and FIG. 9); B is the distance between the stitching line at the interlocking series of teeth of each zipper chain tape and the outer end edge of the end edge of each zipper chain tape; C is the distance of the interlocked part of the two interlocking series of teeth of the two zipper chain tapes; and D is the distance between the two stitching lines at the two interlocking series of teeth of the two zipper chain tapes when the two interlocking series of teeth are engaged together (see FIG. 9).

According to the aforesaid design, the condition of 2B≥D (i.e., 2B<2A) is the waterproof and airtight condition. When compared to conventional techniques, the invention is more in line with the commercialization conditions.

The condition of 2B≥D is that the combined distance of the distance between the stitching line at the interlocking series of teeth of left zipper chain tape and the outer end edge of the end edge of the left zipper chain tape and the distance between the stitching line at the interlocking series of teeth of right zipper chain tape and the outer end edge of the end edge of the right zipper chain tape 2B must be greater than or equal to the distance D between the two stitching lines at the two interlocking series of teeth of the two zipper chain tapes when the two interlocking series of teeth are engaged together. The condition of 2B<2A is that the combined distance of the distance between the stitching line at the interlocking series of teeth of the left zipper chain tape and the outer end edge of the left zipper chain tape and the distance between the stitching line at the interlocking series of teeth of the right zipper chain tape and the outer end edge of the right zipper chain tape must be shorter than the combined distance of the distance between the stitching line at the interlocking series of teeth of the left zipper chain tape and the outer end edge of the respective interlocking series of teeth and the distance between the stitching line at the interlocking series of teeth of the right zipper chain tape and the outer end edge of the respective interlocking series of teeth.

If 2B>2A, the sliding movement of the zipper slider will become unsmooth. The use of a roller type zipper slider can improve sliding smoothness. Modifications and changes can be made without departing from the morphological space design of the present invention, i.e., without departing from the conditions of A+A−C=D, 2B≥D, and 2B<2A.

According to transverse tensile tests made on a #3 zipper chain tape 3 made according to the present invention, the test result can reach 130 kgs~150 kgs, much better than transverse tensile strength of conventional #10 zipper chain tapes (110~130 kgs). When compared to conventional #10 zipper chain tapes, a #3 zipper chain tape 3 made according to the present invention achieves better waterproof, airtight and anti-slit effects and saves much material consumption.

Further, the broad-width fabric tape 62 provided for the mounting of a continuous polyester chain 61 to form a zipper chain tape 6 during step (a) can be woven with a thick warp yarn during its fabrication so as to provide a middle reference line 621 (see FIG. 13 and FIG. 14) for quick alignment of the continuous polyester chain 61 to facilitate accurate stitching. Further, within a predetermined left-right range W around the middle reference line 621, the weft density remains unchanged to maintain the transverse tensile strength of the broad-width fabric tape 62, however the warp yarns are sparsely woven within this left-right range W, providing open spaces 620 that can be filled up by the applied waterproof adhesive or hot melt adhesive glue during step (c), enhancing the waterproof and airtight ability of the zipper.

A waterproof, airtight, anti-slit, high transverse tensile strength double-layer zipper K made according to the aforesaid fabrication method comprises:

two double-layer zipper chain tapes 3, each double-layer zipper chain tape 3 comprising a double-layer zipper tape S formed of a broad-width fabric tape 62 having middle reference line 621 and stitched in shape with stitches, a metal wire yarn core (or elastic plastic rod) 60 embedded in a middle part of a top wall of the broad-width fabric tape 62 and wrapped in the double-layer zipper tape S, a flexible metallic mesh tape 63 attached to the top wall of the broad-width fabric tape 62 and abutted against the metal wire embedded yarn core (or elastic plastic rod) 60 and wrapped in the double-layer zipper tape S, and two series of interlocking teeth 611; 612 respectively stitched to opposing top and bottom sides of the double-layer zipper tape S; and a roller type zipper slider 4 coupled to the two interlocking series of teeth 611; 612 of the two double-layer zipper chain tapes 3 and movable to close and open the zipper.

Further, the invention also provides a third embodiment. This third embodiment is substantially similar to the aforesaid first embodiment with the exception that, in the aforesaid first embodiment, step (a) is to stitch a continuous polyester chain 61 to the front wall of a broad-width fabric tape 62 on the middle to form a zipper chain tape 6 having integrated opposing left and right series of interlocking teeth 611; 612; in this third embodiment, step (a) is to stitch a continuous polyester chain to the front wall of a broad-width fabric tape near its one lateral side to form a zipper chain tape having integrated opposing left and right series of interlocking teeth. The single-sided double-layer zipper chain tape is leaching membrane treatment by water repellent. This third embodiment provides another type of high-strength double-layer zipper. Further, this third embodiment saves fabric consumption.

In conclusion, the invention provides a waterproof, airtight, anti-slit, high transverse tensile strength double-layer zipper K that has advantages and features as follows:

1. In addition to the advantages of waterproof, airtight, anti-slit, high transverse tensile strength characteristics, the zipper slider can be smoothly moved to close/open the double-layer zipper.
2. The metal wire embedded yarn core (or elastic plastic rod) 60 reinforces the tightness of the outer end edge of the zipper chain tape 6, making the double-layer zipper practical for use in an electronic burglar alarm, night lighting or any of a variety of other electronic/electrical equipment devices.
3. Attaching a flexible metallic mesh tape 63 to the broad-width fabric tape 62 and enabling the flexible metallic mesh tape 63 to be wrapped in the double-layer zipper tape S of the folded zipper chain tape 6 during fabrication greatly enhances waterproof, airtight, anti-slit and high transverse tensile strength characteristics of the double-layer zipper, making the double-layer zipper practical for use in a hard travel bag.
4. The broad-width fabric tape 62 provided for the mounting of a continuous polyester chain 61 to form a zipper chain tape 6 during fabrication of the double-layer zipper provides a middle reference line 621 formed of a thick warp yarn for quick alignment of the continuous polyester chain 61 to facilitate accurate stitching; within a predetermined left-right range W around the middle reference line 621, the weft density remains unchanged to maintain the transverse tensile strength of the broad-width fabric tape 62, however the warp yarns are sparsely woven within this left-right range W, providing open spaces 620 that can be filled up by the applied waterproof adhesive or hot melt adhesive glue during step (c), and therefore the waterproof and airtight ability of the double-layer zipper is enhanced.

What is claimed is:

1. A waterproof, airtight, anti-slit, high transverse tensile strength double-layer zipper comprising two opposed double-layer zipper chain tapes, each said double-layer zipper chain tape comprising a double-layer zipper tape formed of a metal wire or elastic plastic rod core, a folded broad-width fabric tape folded so as to enclose the metal wire or elastic plastic rod core at a closed side of the double-layer zipper tape, and two series of interlocking teeth respectively stitched to opposing top and bottom sides of said double-layer zipper tape, and a roller type zipper slider coupled to said two interlocking series of teeth of said two double-layer zipper chain tapes and movable to close and open the zipper, wherein the waterproof, airtight, anti-slit, high transverse tensile strength double-layer zipper satisfies the conditions of $A+A-C=D$, $2B \geq D$, and $2B<2A$ wherein A is the distance between the stitching line at the interlocking series of teeth of each zipper chain tape and the outer end edge of the respective interlocking series of teeth; B is the distance between the stitching line at the interlocking series of teeth of each zipper chain tape and the outer end edge of the end edge of each zipper chain tape; C is the distance of the interlocked part of the two interlocking series of teeth of the two zipper chain tapes; and D is the distance between the two stitching lines at the two interlocking series of teeth of the two zipper chain tapes when the two interlocking series of teeth are engaged together.

2. The waterproof, airtight, anti-slit, high transverse tensile strength double-layer zipper as claimed in claim 1, wherein the two series of interlocking teeth at the opposing top and bottom sides of said double-layer zipper tape is formed of continuous polyester chains stitched to a middle part or one lateral side of said broad-width fabric tape and split into said two series of interlocking teeth.

3. The waterproof, airtight, anti-slit, high transverse tensile strength double-layer zipper as claimed in claim 1, wherein said double-layer zipper tape has opposing upper and lower fabric tape portions thereof fixedly secured of together with stitches.

4. The waterproof, airtight, anti-slit, high transverse tensile strength double-layer zipper as claimed in claim 1, wherein said broad-width fabric tape of said double-layer zipper tape of each said double-layer zipper chain tape comprises a middle reference line and a predetermined left-right range around said middle reference line so configured that the weft density within said predetermined left-right range around said middle reference line is higher than the warp density within said predetermined left-right range around said middle reference line so that spaces are provided within said predetermined left-right range around said middle reference line with waterproof adhesive in the spaces.

5. The waterproof, airtight, anti-slit, high transverse tensile strength double-layer zipper as claimed in claim 1, wherein the two series of interlocking teeth at the opposing top and bottom sides of said double-layer zipper tape is formed of continuous polyester chains stitched to a middle part of said broad-width fabric tape and split into said two series of interlocking teeth, said broad-width fabric tape comprising a thick warp yarn defining a middle reference line, the weft density of said broad-width fabric tape within a predetermined left-right range around said middle reference line being higher than the warp density of said broad-width fabric tape within said predetermined left-right range around said middle reference line so that spaces are provided within said predetermined left-right range around said middle reference line with waterproof adhesive in the spaces.

6. The double-layer zipper of claim 1, further comprising a flexible metallic mesh tape wrapped in the folded broad-width fabric tape.

* * * * *